United States Patent [19]

Sutton

[11] Patent Number: 5,025,170

[45] Date of Patent: Jun. 18, 1991

[54] UNDERWATER MAGNETIC SWITCH FOR ELECTRICAL CABLE TRANSMITTING A.C. ELECTRICAL CURRENT

[75] Inventor: Owen W. Sutton, San Diego, Calif.

[73] Assignee: AT&T Bell Laboratories, Murray Hill, N.J.

[21] Appl. No.: 516,964

[22] Filed: Apr. 30, 1990

[51] Int. Cl.[5] ..... H01H 36/00

[52] U.S. Cl. ..... 307/116

[58] Field of Search ..... 307/116, 112, 125; 335/205, 206; 361/42, 45

[56] References Cited

U.S. PATENT DOCUMENTS

| | | | |
|---|---|---|---|
| 3,446,991 | 5/1969 | Howell | 307/632 |
| 3,976,963 | 8/1976 | Kübler | 335/206 |
| 4,309,734 | 1/1982 | Warren | 361/58 |
| 4,380,704 | 4/1983 | Wisda | 307/116 |
| 4,410,925 | 10/1983 | Tucker et al. | 361/42 |
| 4,458,299 | 7/1984 | Stephens et al. | 362/158 |
| 4,634,253 | 1/1987 | Tamamura | 354/403 |

*Primary Examiner*—A. D. Pellinen
*Assistant Examiner*—Brian Johannssen
*Attorney, Agent, or Firm*—L. H. Birnbaum

[57] ABSTRACT

A high amperage underwater magnetic switch for A.C. electrical current. The magnetic switch circuit is incorporated into one of the three electrical conductors passing through an underwater electrical cable. The magnetic switch circuit has a triac and a magnetic reed switch in it. The magnetic switch circuit is located inside a tubular sleeve that has been filled with epoxy resin to make it waterproof. The switch may be manually operated externally by a magnet mounted on a sliding collar that surrounds the tubular sleeve.

4 Claims, 3 Drawing Sheets

UNDERWATER MAGNETIC SWITCH FOR ELECTRICAL CABLE TRANSMITTING A.C. ELECTRICAL CURRENT

BACKGROUND OF THE INVENTION

The invention relates to a magnetic switch and more specifically to one used with electrical cable for transmitting A.C. electrical current underwater.

Presently underwater electrical cables used by divers and marine operations utilize D.C. current. Since it requires a large sized generator to run D.C. current the length of a cable underwater, many operations utilize 110 A.C. current to a ballast located above the water that changes the current to D.C. for the submerged cable. The major drawback for D.C. current is because of the resistance and impedance of the cable. With A.C. current, you do not have that major problem.

It is an object of the invention to provide a novel underwater magnetic switch for electrical cable transmitting A.C. electrical current that can be manually operated by a diver under water.

It is also an object of the invention to provide a novel underwater magnetic switch for electrical cable transmitting A.C. electrical current that is turned off an on by a magnet positioned externally of the underwater electrical cable.

It is another object of the invention to provide a novel underwater magnetic switch for electrical cable transmitting A.C. electrical current that is easily installed in existing underwater electrical cable.

It is a further object of the invention to provide a novel underwater magnetic switch for electrical cable transmitting A.C. electrical current that is economical to manufacture and market. It is an additional object of the invention to provide a novel underwater magnetic switch for electrical cable transmitting A.C. electrical current that is completely waterproof.

SUMMARY OF THE INVENTION

Applicant's novel underwater magnetic switch for electrical cable transmitting A.C. electrical current has been designed so that it may be manually operated underwater by a diver. The magnetic switch circuit is connected to one of the electrical conductors passing through an underwater electrical cable. The magnetic switch circuit incorporates a triac and a magnetic reed switch. The magnetic switch circuit is mounted within a tubular sleeve that has been filled with epoxy resin to hermetically seal it from water penetration.

A sliding collar surround the tubular sleeve and is reciprocally slidable forward and aft. A magnet is mounted on the sliding collar adjacent the magnetic reed switch so that it's reciprocal movement will cause the switch to open and close.

The ends of the underwater electrical cable have waterproof connectors or plugs secured to them. This allows one end of the underwater cable to be connected above water to an A.C. source of electrical power. Tools, magnetic inspection members, lights, etc. may be electrically connected to the end of the underwater cable located beneath the surface of the water.

By using triacs having different amperage capacity, A.C. current can be transmitted through the underwater electrical cable up to 100 amps. The resistor in series with the magnetic Cable 12 has three electrical conductors 13, 14, and 15 passing through it from it's front end to its rear end electrical conductor 13 is a ground wire.

A plug 18 is connected to the front end of cable 12 and underwater connector 19 is connected to its rear end.

Magnetic switch assembly 10 is mounted in tubular sleeve 20 that is filled with epoxy resin. Sliding collar 22 has a magnet 24 mounted therein and it reciprocally travels between stop 26 and stop 27.

The magnetic switch circuit is best illustrated in FIG. 2. An A.C. source of electric current 30 is connected by conductors 14 and 15 to a load 32. The magnetic switch circuit has a triac 34, a magnetic reed switch 36, a resistor 37, and a sliding magnet 40. Triac 34 has a source of electric current input connection terminal, a load connection terminal, and a trigger terminal. The triac stops current from flowing through electrical conductor 15 until magnetic reed switch 36 is closed. Thus, whether plug 18 is disconnected or connected to a load, triac 34 will prevent current from completing a circuit. When magnet 40 is moved to its on/position, magnetic reed switch 36 closes allowing current to pass through triac 34. Resistor 37 limits the current passing through magnetic reed switch 36 and it prevents a split of the current passing through electrical conductor 15.

In FIG. 3, the schematic diagram shows the novel magnetic switch connected to an inspection magnet 50 and a box 80 mounted out of the water. A waterproof cable containing conductors 51,52, and 53 have their one end connected to inspection magnet 50 and their opposite ends connected to connector 56. Mounted in box 80 in it's side walls are female plugs 61 and 62. Electrical conductor 63 is a ground line. Electrical conductor 64 and 65 are connected to ground fault 60. Ground fault 60 functions as a circuit breaker if water should leak into the tubular sleeve 20 of the underwater connector and contact ground wire 13. Electrical conductor 66 is connected to resistors 68 and 69 and ammeter 70. The ammeter 70 is used to monitor the current being used by inspection magnet 50. Electrical connector 67 is connected to female connection plug 61. Male plug 80 is connected to a 110 volt source of A.C. current. reed switch functions to prevent the magnetic reed switch from taking a jolt when it is turned on.

Applicant's novel underwater magnetic structure allows it to be utilized with an underwater magnetic inspection unit that utilizes high amperage alternating current. It would be manually operated by the in-line magnetic switch. This switch allows the diver to operate the inspection unit or equipment at the underwater site.

DESCRIPTION OF THE PREFERRED EMBODIMENT

Figure 1:
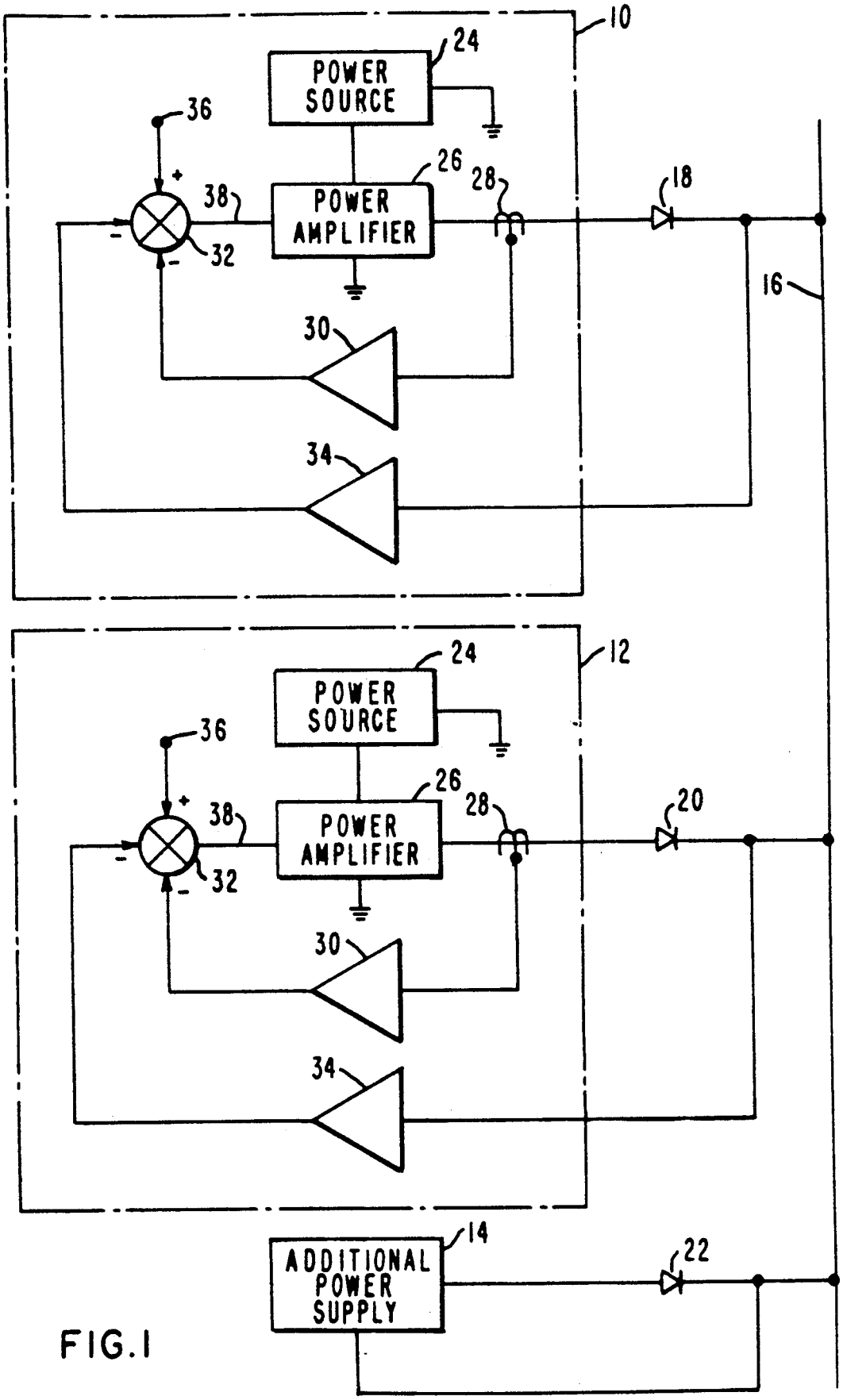
FIG. 1 is a side elevation view showing an underwater electrical cable having applicant's novel magnetic switch mounted therein.

Applicant's novel underwater magnetic switch for electrical cable for transmitting A.C. electrical current will now be described by referring to FIGS. 1–3 of the drawing. The magnetic switch assembly is generally designated numeral 10.

Magnetic switch assembly 10 is generally mounted intermediate the ends of an underwater electrical cable 12.

What is claimed is:

1. An underwater magnetic switch for electrical cable transmitting A.C. electrical current comprising:

a predetermined length of underwater electrical cable having a front end and a rear end;

at least three primary electrical conductors passing longitudinally through said cable from its front end to its rear end;

the first of said primary electrical conductors having a magnetic reed switch in the circuit intermediate its ends, said magnetic reed switch having first and second connection terminals;

the second of said primary electrical conductors being a current carrying conductor;

the third of said primary electrical conductors being a ground wire;

a triac having a source of electrical current input connection terminal, a load connection terminal and a trigger terminal;

the trigger terminal of said triac being electrically connected to the first connection terminal of said magnetic reed switch, the input terminal of said triac being connected to said first primary electrical conductor, the load connection terminal of said triac being connected to said first primary electrical conductor;

said second connection terminal of said magnetic reed switch being electrically connected to said first primary electrical conductor prior to the conductors connection to the input terminal of said triac;

said magnetic reed switch, said triac and a predetermined portion of said three primary electrical conductors being surrounded by an elongated tubular waterproof casing and said casing is filled with a hardened epoxy resin; and a tubular collar, having a magnet mounted thereon, surround said tubular casing and it is mounted thereon so that it can be reciprocally moved to respective positions for opening and closing said magnetic reed switch.

2. An underwater magnetic switch for electrical cable transmitting A.C. electrical current as recited in claim 1 further comprising a resistor connected in series between said second connection terminal and said first primary electrical conductor prior to the conductors connection to the input terminal of said triac.

3. An underwater magnetic switch for electrical cable transmitting A.C. electrical current as recited in claim 1 wherein the rear end of said cable is detachably connected to an outlet plug mounted in the side wall of a control box, said control box also having an inlet plug and three main electrical conductors extend between said inlet plug and said outlet plug, said first primary electrical conductor would be connected to the first main electrical conductor, said second primary electrical conductor would be connected to the second main electrical conductor, and said third primary electrical conductor, would be connected to the third main electrical conductor that is a ground wire.

4. An underwater magnetic switch for electrical cable transmitting A.C. electrical current as recited in claim 3 further comprising an ammeter in series with said second main electrical conductor in said control box for measuring the current being passed through a load connected to the front end of said underwater electrical cable.

* * * * *

UNITED STATES PATENT AND TRADEMARK OFFICE

CERTIFICATE OF CORRECTION

PATENT NO. : 5,025,170

DATED : June 18, 1991

INVENTOR(S) : Owen W. Sutton

It is certified that error appears in the above-indentified patent and that said Letters Patent is hereby corrected as shown below:

The title page should be deleted to appear as per attached title page.

Item [73] Assignee: should read --NONE--
Item [56] Attorney, Agent, or Firm: should read --Charles C. Logan, II On the title page, column 2, after Abstract, should read --4 Claims, 1 Drawing Sheet--

Column 3, line 3, insert the following text after 12 and before "What is claimed is:"

--Cable 12 has three electrical conductors 13, 14, and 15 passing through it from it's front end to its rear end. Electrical conductor 13 is a ground wire, a plug 18 is connected to the front end of cable 12 and underwater connector 19 is connected to its rear end.

Magnetic switch assembly 10 is mounted in tubular sleeve 20 that is filled with epoxy resin. Sliding collar 22 has a magnet 24 mounted therein and it reciprocally travels between stop 26 and stop 27.

Figure 2:
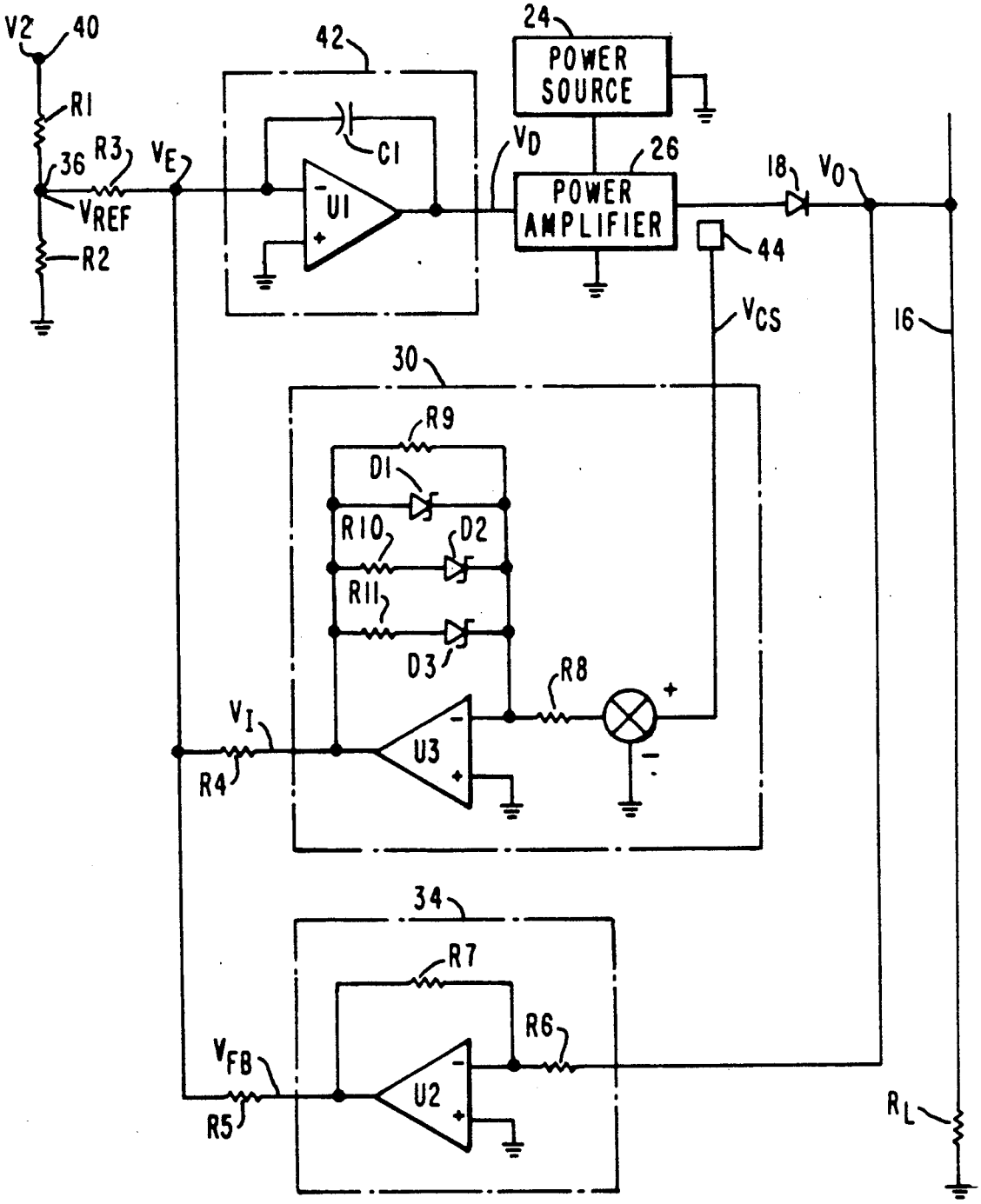
FIG. 2 is a schematic illustration of the magnetic switch circuitry.

The magnetic switch circuit is best illustrated in Figure 2. An A.C. source of electric current 30 is connected by conductors 14 and 15 to a load 32. The magnetic switch circuit has a triac 34, a magnetic reed switch 36, a resistor 37, and a sliding magnet 40. Triac 34 has a source of electric

UNITED STATES PATENT AND TRADEMARK OFFICE

CERTIFICATE OF CORRECTION

PATENT NO. : 5,025,170

DATED : June 18, 1991

INVENTOR(S) : Owen W. Sutton

It is certified that error appears in the above-indentified patent and that said Letters Patent is hereby corrected as shown below:

current input connection terminal; a load connection terminal, and a trigger terminal. The triac stops current from flowing through electrical conductor 25 until magnetic reed switch 36 is closed. Thus, whether plug 18 is disconnected or connected to a load, triac 34 will prevent current from completing a circuit. When magnet 40 is moved to its on/ position, magnetic reed switch 36 closes allowing current to pass through triac 34. Resistor 37 limits the current passing through magnetic reed switch 36 and it prevents a split of the current passing through electrical conductor 15.

Figure 3:
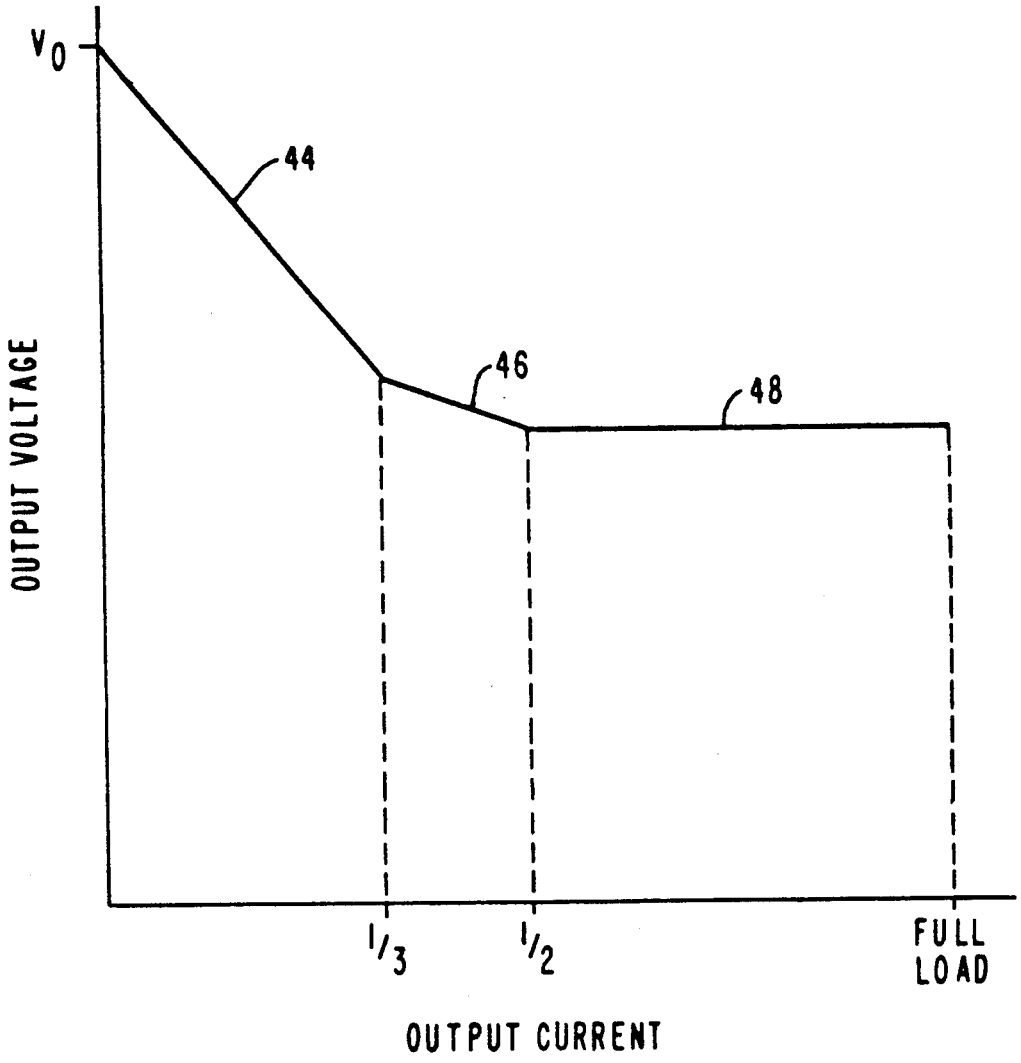
FIG. 3 is a schematic illustration of the underwater magnetic switch in combination with a control box having a ground fault and ammeter therein.
Figure 2:
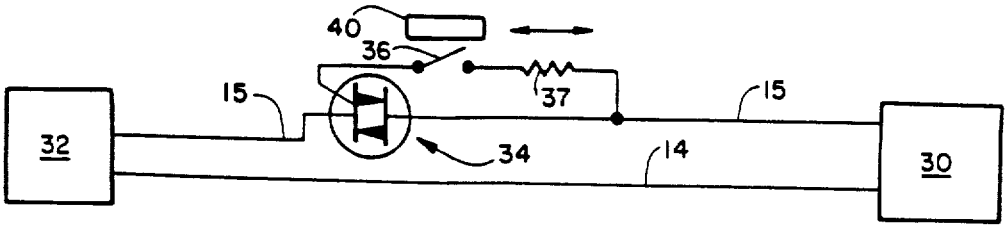
Figure 1:
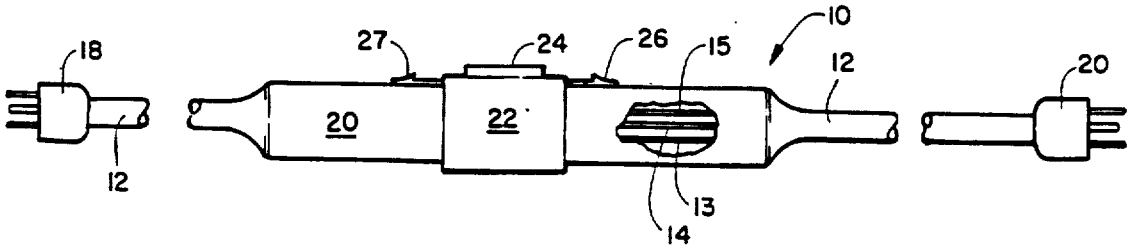
Figure 3:
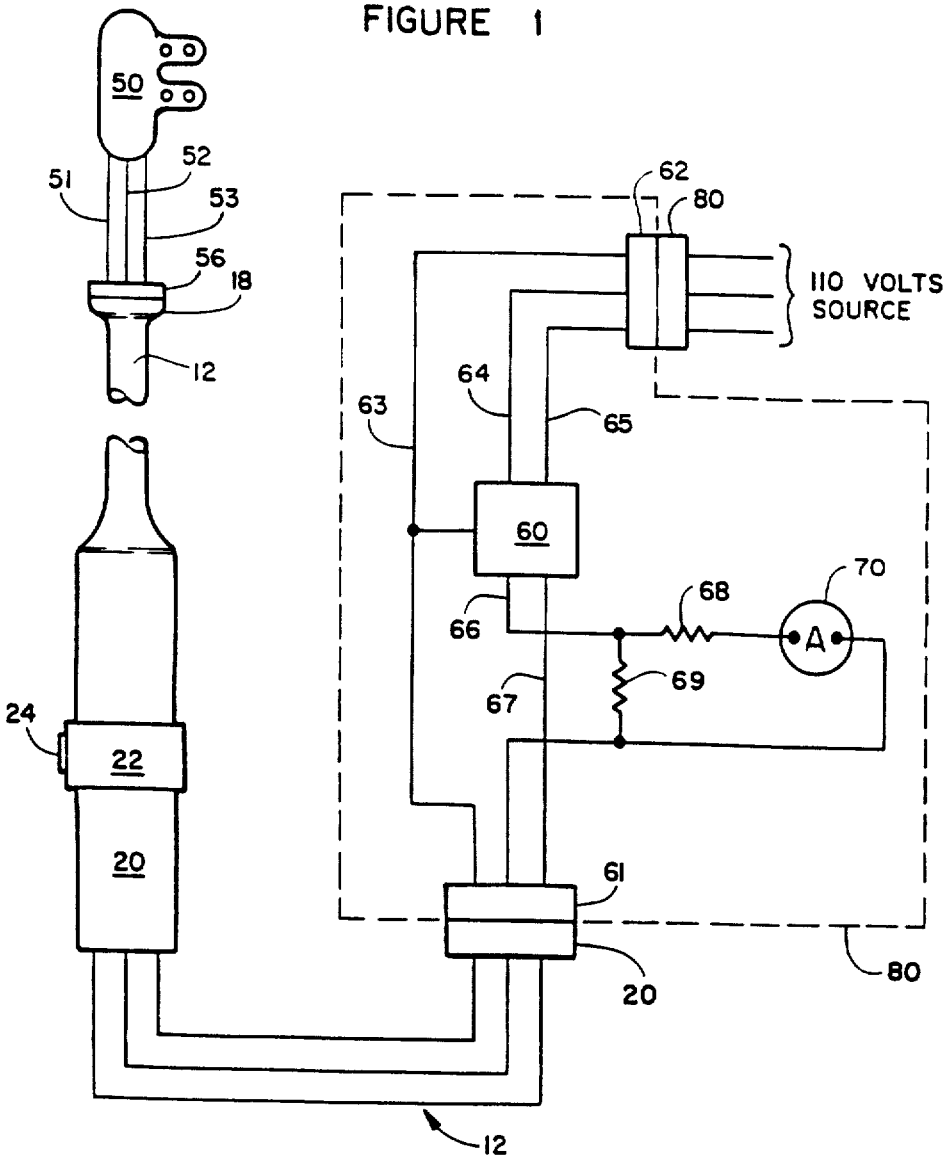

In Figure 3, the schematic diagram shows the novel magnetic switch connected to an inspection magnet 50 and a box 80 mounted out of the water. A waterproof cable containing conductors 51,52, and 53 have their one end connected to inspection magnet 50 and their opposite ends connected to connector 56. Mounted in box 80 in it's side walls are female plugs 61 and 62. Electrical conductor 63 is a ground line. Electrical conductor 64 and 65 are connected to ground fault 60. Ground fault 60 functions as a circuit breaker if water should leak into the tubular sleeve 20

UNITED STATES PATENT AND TRADEMARK OFFICE

CERTIFICATE OF CORRECTION

PATENT NO. : 5,025,170

DATED : June 18, 1991

INVENTOR(S) : Owen W. Sutton

It is certified that error appears in the above-indentified patent and that said Letters Patent is hereby corrected as shown below:

of the underwater connector and contract ground wire 13. Electrical conductor 66 is connected to resistors 68 and 69 and ammeter 70. The ammeter 70 is used to monitor the current being used by inspection magnet 50. Electrical connector 67 is connected to female connection plug 61. Male plug 80 is connected to a 110 volt source of A.C. current.

The sheet of drawing consistings of Figures 1,2,&3 should be deleted. The sheet of drawing consisting of Figures 1,2 &3 should be added as shown on the attached sheet.

Signed and Sealed this

Third Day of May, 1994

*Attest:*

*Attesting Officer*

BRUCE LEHMAN

*Commissioner of Patents and Trademarks*

United States Patent [19]

Sutton

[11] Patent Number: 5,025,170

[45] Date of Patent: Jun. 18, 1991

[54] UNDERWATER MAGNETIC SWITCH FOR ELECTRICAL CABLE TRANSMITTING A.C. ELECTRICAL CURRENT

[75] Inventor: Owen W. Sutton, San Diego, Calif.

[73] Assignee: AT&T Bell Laboratories, Murray Hill, N.J.

[21] Appl. No.: 516,964

[22] Filed: Apr. 30, 1990

[51] Int. Cl.[5] ..... H01H 36/00

[52] U.S. Cl. ..... 307/116

[58] Field of Search ..... 307/116, 112, 125; 335/205, 206; 361/42, 45

[56] References Cited

U.S. PATENT DOCUMENTS

| | | | |
|---|---|---|---|
| 3,446,991 | 5/1969 | Howell | 307/632 |
| 3,976,963 | 8/1976 | Kübler | 335/206 |
| 4,309,734 | 1/1982 | Warren | 361/58 |
| 4,380,704 | 4/1983 | Wisda | 307/116 |
| 4,410,925 | 10/1983 | Tucker et al. | 361/42 |
| 4,458,299 | 7/1984 | Stephens et al. | 362/158 |
| 4,634,253 | 1/1987 | Tamamura | 354/403 |

*Primary Examiner*—A. D. Pellinen
*Assistant Examiner*—Brian Johannssen
*Attorney, Agent, or Firm*—L. H. Birnbaum

[57] ABSTRACT

A high amperage underwater magnetic switch for A.C. electrical current. The magnetic switch circuit is incorporated into one of the three electrical conductors passing through an underwater electrical cable. The magnetic switch circuit has a triac and a magnetic reed switch in it. The magnetic switch circuit is located inside a tubular sleeve that has been filled with epoxy resin to make it waterproof. The switch may be manually operated externally by a magnet mounted on a sliding collar that surrounds the tubular sleeve.

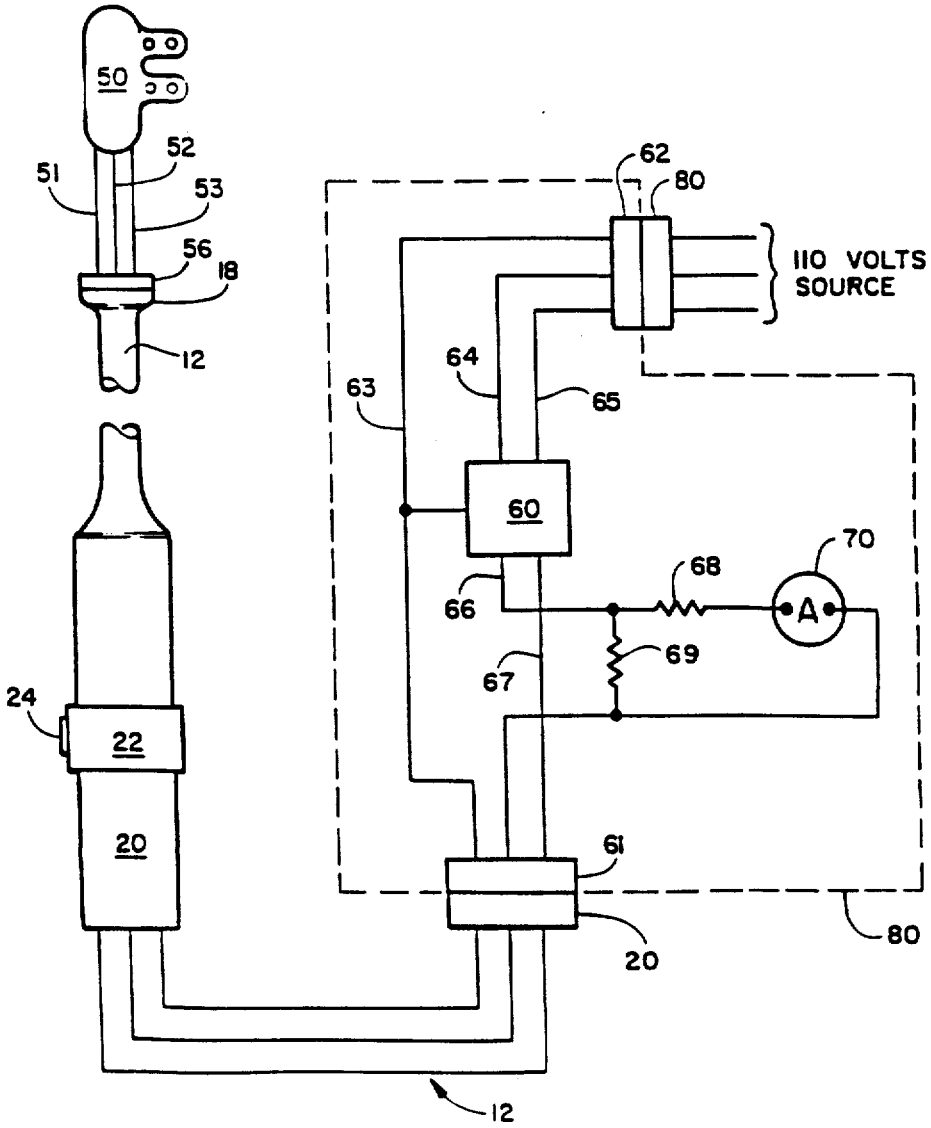

4 Claims, 3 Drawing Sheets